US006015001A

United States Patent [19]

Tronsgard et al.

[11] Patent Number: 6,015,001

[45] Date of Patent: Jan. 18, 2000

[54] TWO TIER VENETIAN BLIND

[76] Inventors: Ken Tronsgard; Jocelyn Tronsgard, both of 1252 - 97th Street, North Battleford, Saskatchewan, Canada, S9A 0J7

[21] Appl. No.: 09/128,134

[22] Filed: Aug. 3, 1998

[51] Int. Cl.[7] ..... E06B 3/48

[52] U.S. Cl. ..... 160/115; 160/167; 160/176.1 R; 160/178.3 R

[58] Field of Search ..... 160/115, 114, 160/116, 168.1 R, 167 R, 173 R, 178.1 R, 178.3 R, 236

[56] References Cited

U.S. PATENT DOCUMENTS

| | | | |
|---|---|---|---|
| 214,158 | 4/1879 | Langdon | 160/115 |
| 2,459,517 | 1/1949 | Gearhart | 160/115 |
| 2,506,507 | 5/1950 | Kiatta | 160/115 |
| 2,587,696 | 3/1952 | Collier | 160/115 |
| 2,719,586 | 10/1955 | Graham | 160/115 |
| 2,836,237 | 5/1958 | Hogin et al. | 160/115 |
| 3,111,164 | 11/1963 | Lombard | 160/115 |
| 4,621,672 | 11/1986 | Hsu . | |
| 4,951,729 | 8/1990 | Chi Yu | 160/115 X |
| 5,232,037 | 8/1993 | Fraser | 160/115 |
| 5,485,874 | 1/1996 | Whitmore . | |
| 5,582,226 | 12/1996 | Voss et al. | 160/178.3 R X |
| 5,839,494 | 11/1998 | Judkins | 160/167 |

FOREIGN PATENT DOCUMENTS

| | | | |
|---|---|---|---|
| 778185 | 2/1968 | Canada | 160/115 |

*Primary Examiner*—Daniel P. Stodola
*Assistant Examiner*—Bruce A. Lev
*Attorney, Agent, or Firm*—Adams Law Firm, P.A.

[57] ABSTRACT

A two tier venetian blind comprises an upper and a lower tier of slats suspended from a blind control mechanism; a front upper control cord and a back upper control cord for tilting the upper tier of slats; a front lower control cord and a back lower control cord for tilting the lower tier of slats; and a lift cord passing through a lift cord hole in each slat in the upper and lower tiers of slats. To avoid having the lower control cords hang when the blind is raised, the front lower control cord passes through the lift cord holes in each slat in the upper tier of slats and the back lower control cord passes around the back upper control cord at a plurality of points along the back upper control cord. In this way the lower control cords are gathered as the blind is raised.

5 Claims, 2 Drawing Sheets

TWO TIER VENETIAN BLIND

This invention deals with the field of window coverings and in particular with venetian blinds wherein an upper portion may be adjusted to a different angle than the lower portion.

BACKGROUND

Prior art has been directed to providing a two tier venetian blind with an upper tier and a lower tier wherein the slats may be adjusted to different angles in each tier. This allows the slats in the lower tier to be closed for privacy while the upper slats are open for light, or vice versa for shade from the closed upper tier and ventilation from the open bottom tier.

U.S. Pat. No. 4,621,672 to Hsu discloses a mechanism that will provide such independent control of upper and lower tiers of a venetian blind using a single control rod. The Hsu device does not address the problem of the control cords for the lower slats hanging when the upper tier of the blind is raised.

The upper and lower tiers require separate control cords so there are two adjacent control cords on the front of the blind and two on the back leading down from the blind control mechanism at the top of the blind. The upper control cords only reach to the bottom of the upper tier of slats, and are joined front to back by cross cords that act to tilt the slats when the control cords are moved—as the front cord goes up the back cord goes down and the cross cords, and therefore the slats, are tilted accordingly. The lower control cords are not connected by cross cords until they reach the bottom tier of slats. Thus when the bottom tier slats are tilted the upper tier slats do not move.

The blind acts normally during the first stage of raising with the lower front and back control cords being gathered by their attachment to the cross cords. Once the lower tier has been raised however, there are no more cross cords attaching those front and back lower control cords and so they hang in a loop when the upper tier slats are raised. In the Hsu device those cords merely hang, being then unsightly and presenting a possible hazard.

U.S. Pat. No. 5,485,874 to Whitmore addresses this hanging lower control cord problem by providing various mechanisms such as washers, cord loops and bands, by which the upper and lower control cords on each side of the blind are held together when the upper tier of the blind is raised. In one embodiment he also provides apertures on the front and back side of each slat through which the front and back lower control cords pass.

A simple cord arrangement solving this problem that involves no modification to the slats of an existing blind would be beneficial. Costs for providing a two tier blind would be reduced if only the blind control mechanism at the top of the blind required modification to provide a two tier blind.

SUMMARY OF THE INVENTION

It is the object of the present invention to provide a simple method of preventing the lower control cords on a two tier venetian blind from hanging in an unsightly and unsafe manner when the blind is raised.

The present invention accomplishes these objects providing a two tier venetian blind comprising a blind control mechanism; an upper tier of slats suspended from said blind control mechanism; a lower tier of slats suspended from said blind control mechanism below said upper tier of slats; a front upper control cord and a back upper control cord operatively connected to only said upper tier of slats and to said blind control mechanism for tilting said upper tier of slats; a front lower control cord and a back lower control cord operatively connected to only said lower tier of slats and to said blind control mechanism for tilting said lower tier of slats; and a lift cord passing through a lift cord hole in each slat in said upper and lower tiers of slats, said lift cord operatively connected to the blind control mechanism at its top end and attached at its bottom end to the bottom slat in said lower tier of slats such that said blind control mechanism may be operated to draw said lift cord up, thereby raising firstly said lower tier of slats and then said upper tier of slats; wherein said front lower control cord passes through said lift cord holes in each slat in said upper tier of slats; and wherein said back lower control cord passes around said back upper control cord at a plurality of points along said back upper control cord.

Each slat of the upper tier of slats could rest on an upper cross cord attached between the front and back upper control cords and each slat of the lower tier of slats could rest on a lower cross cord attached between the front and back lower control cords. The front lower control cord and the lift cord could be positioned on opposite sides of the upper cross cords as they pass through the upper slats. Normally the lift cord is positioned on alternating sides of the cross cords in order to prevent the control cords from moving out of alignment. Positioning the lift cord and front lower control chord on opposite sides of the upper cross cords would serve the same purpose and result in less friction on the cords.

The back lower control cord could conveniently pass around the back upper control cord at every fourth slat in the upper tier of slats. This passing of one cord around the other serves to gather the back lower control cord as the blind is raised while allowing it to move up and down independently of the back upper control cord.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
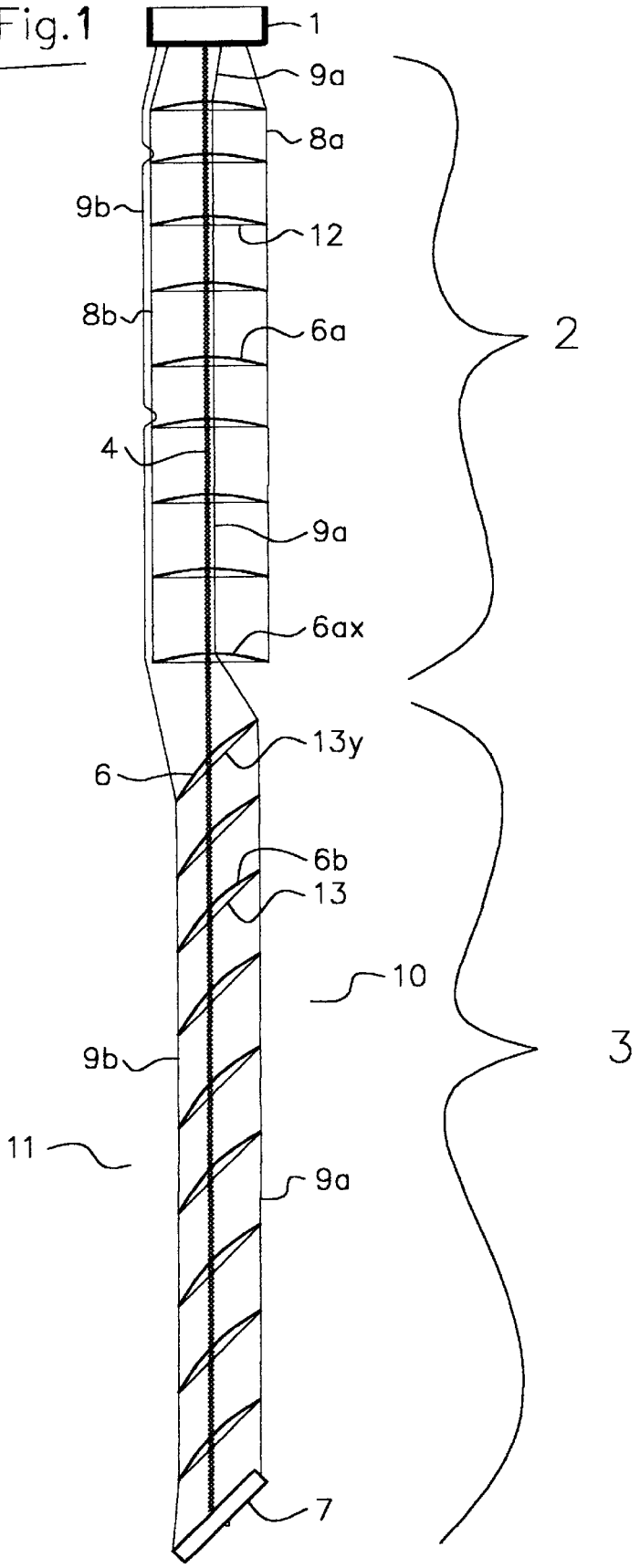
FIG. 1 is a side view of the preferred embodiment.

The preferred embodiment is illustrated in FIG. 1. Blind control mechanism 1 is a dual control mechanism as is known in the prior art which provides separate control for each of the upper tier of slats 2 and lower tier of slats 3. Blind control mechanism 1 is mounted to a window by conventional means.

Lift cord 4 extends down from the blind control mechanism 1 through lift cord holes 5 in each slat 6 in the upper and lower tiers 2,3 and is attached to the bottom slat 7, which is heavier than the other slats so that the blind will drop when the lift cord is released. When the lift cord 4 is drawn up by the blind control mechanism 1, the bottom slat 7 is first raised into contact with the next slat 6*b* of the lower tier 3 above, and so on, raising first the lower slats 6*b* and then the upper slats 6*a* in turn until the blind is fully raised.

Upper control cords, 8*a* on the front side 10 of the blind and 8*b* on the back side 11 of the blind, extend from the blind control mechanism 1 down to the lowest slat, 6*ax*, in the upper tier 2. Upper cross cords 12 are attached to the front and back upper control cords 8*a*, 8*b* at intervals along their length, and the upper slats 6*a* rest on these. As the front upper control cord 8*a* moves up, the back upper control cord 8*b* moves down thereby tilting the slats 6*a* resting on the upper cross cords 12.

Similarly lower control cords 9*a* on the front side 10 of the blind and 9*b* on the back side 11 of the blind are joined by lower cross cords 13 and the lower slats 6*b* rest on these. The lower control cords 9*a*, 9*b* are not connected across the blind until the top of the lower tier 3. It can be seen then that when the blind is raised as described above, the upper portions of the lower control cords 9*a*, 9*b* would simply hang in an unsightly and unsafe manner if they were not contained or gathered in some way.

Figure 2:
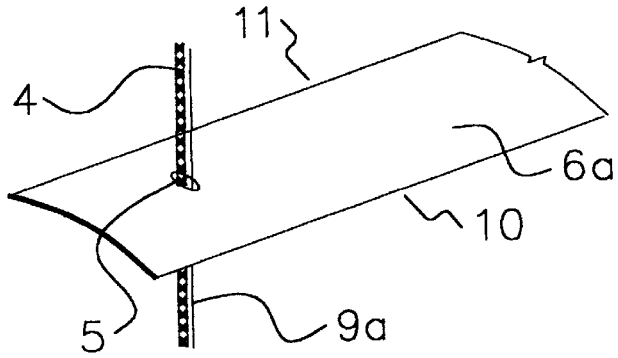
FIG. 2 is a perspective view of a lift cord hole in an upper slat of the embodiment of FIG. 1.

To avoid this problem, as best seen in FIG. 2, the upper portion of the front lower control cord 9*a* passes from the uppermost lower cross cord 13*y* through the lift cord hole 5 in the lowest upper slat 6*ax* and thence through the lift cord holes 5 in all the upper slats 6*a* and then entering the blind control mechanism 1. The front lower control cord 9*a* is free to move up and down to tilt the lower slats 6*b*, and as the blind is raised it is gathered by the upper slats 6*a*.

Figure 3:
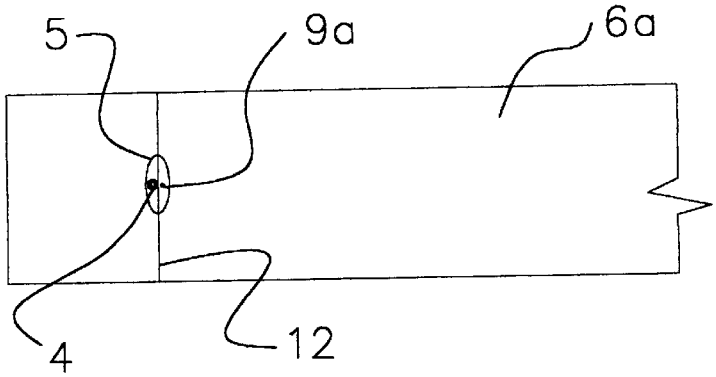
FIG. 3 is a bottom view of the upper slat of FIG. 2.

As illustrated in FIG. 3, the front lower control cord 9*a* is positioned on one side of the upper cross cord 12 while the lift cord 4 is positioned on the opposite side thereof. This positioning serves to prevent the cross cords and front and back upper control cords from moving out of alignment while reducing the friction between cords caused by the conventional alternating of the lift cord on either side of the cross cords. The lift cord 4 is positioned in the conventional way in the lower tier of slats 3, passing on alternate sides of the lower cross cords 13.

The upper portion of the back lower control cord 9*b* is passed around the back upper control cord 8*b* at intervals. The interval is dictated by the need to allow the back lower control cord 9*b* and back upper control cord 8*b* to move freely up and down independently of each other without binding, and the need to gather the control cord 9*b* during raising so that it does not hang below the raised blind. It is contemplated that an interval of three to four slats will generally provide for both of these needs. This gathering on the back side 11 of the blind will not be as neat as that of the front lower control cord 9*a* within the upper blind slats 6*a*, however as it is on the back of the blind 11, it will be out of sight in most cases and so not pose a problem.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

We claim:

1. A two tier venetian blind comprising:

a blind control mechanism;

an upper tier of slats suspended from said blind control mechanism;

a lower tier of slats suspended from said blind control mechanism below said upper tier of slats;

a front upper control cord and a back upper control cord operatively connected to only said upper tier of slats and to said blind control mechanism for tilting said upper tier of slats;

a front lower control cord and a back lower control cord operatively connected to only said lower tier of slats and to said blind control mechanism for tilting said lower tier of slats; and a lift cord passing through a lift cord hole in each slat in said upper and lower tiers of slats, said lift cord operatively connected to the blind control mechanism at its top end and attached at its bottom end to the bottom slat in said lower tier of slats such that said blind control mechanism may be operated to draw said lift cord up, thereby raising firstly said lower tier of slats and then said upper tier of slats;

wherein said front lower control cord passes through said lift cord holes in each slat in said upper tier of slats; and wherein said back lower control cord passes around said back upper control cord at a plurality of points along said back upper control cord.

2. The invention of claim 1 wherein each slat of said upper tier of slats rests on an upper cross cord attached between said front and back upper control cords and wherein each slat of said lower tier of slats rests on a lower cross cord attached between said front and back lower control cords.

3. The invention of claim 2 wherein said lift cord and said front lower control cord are positioned on opposite sides of said upper cross cords as they pass through said upper slats.

4. The invention of claim 2 wherein said back lower control cord passes around said back upper control cord at every fourth slat in said upper tier of slats.

5. The invention of claim 1 wherein said back lower control cord passes around said back upper control cord at every fourth slat in said upper tier of slats.

* * * * *